US006831558B1

(12) United States Patent
Andrew

(10) Patent No.: US 6,831,558 B1
(45) Date of Patent: Dec. 14, 2004

(54) MAILBOX OPERATED SIGNAL DEVICE

(76) Inventor: Robert B. Andrew, 1342 46th Ave. NE., Saint Petersburg, FL (US) 33703

( * ) Notice: Subject to any disclaimer, the term of this patent is extended or adjusted under 35 U.S.C. 154(b) by 25 days.

(21) Appl. No.: 10/273,650

(22) Filed: Oct. 18, 2002

(51) Int. Cl.[7] ..... G08B 1/08

(52) U.S. Cl. ..... 340/539.2; 340/557; 340/568.1; 340/569; 340/691.1; 200/61.61; 200/61.63; 232/17; 232/20; 232/21

(58) Field of Search ..... 340/539.2, 569, 340/568.1, 570, 555, 556, 557, 551, 552, 691.1, 691.6; 232/17, 19, 20, 21, 24, 27, 34, 35, 36, 45; 200/61.61, 61.63

(56) References Cited

U.S. PATENT DOCUMENTS 4,868,543 A * 9/1989 Binkley ..... 340/569
6,028,517 A * 2/2000 Sansone et al. ..... 340/569
6,114,959 A * 9/2000 Bennett ..... 340/569
6,275,154 B1 * 8/2001 Bennett et al. ..... 340/569
6,459,375 B1 * 10/2002 Wallace ..... 340/569
6,462,659 B1 * 10/2002 Schuette ..... 340/569
6,483,433 B2 * 11/2002 Moskowitz et al. ..... 340/568.1

* cited by examiner

*Primary Examiner*—Davetta W. Goins

(57) ABSTRACT

A mailbox operated signal device has a motion detector that is attached to the inside of a conventional mailbox and activates a light and a speaker to alert residents that the mail has been delivered to their mailbox. A wireless transmitter is electrically connected to the motion detector. The wireless transmitter is capable of transmitting a motion detected signal. A wireless receiver is capable of receiving the transmitted motion detected signal. A light is electrically connected to the wireless receiver. The light is for indicating when the motion detected signal is received by the wireless receiver.

1 Claim, 3 Drawing Sheets

MAILBOX OPERATED SIGNAL DEVICE

BACKGROUND OF THE INVENTION

1. Field of the Invention

The present invention relates to a mailbox operated signal device for use in connection with mailbox accessories. The mailbox operated signal device has particular utility in connection with mailbox operated motion detector.

2. Description of the Prior Art

Mailbox operated signal devices are desirable for fulfilling the need of a unit that would activate an audio tone or a light to alert homeowners that mail has been delivered to their roadside mailbox.

The use of mailbox accessories is known in the prior art. For example, U.S. Pat. No. 3,611,333 to Conigliaro discloses a mailbox operated electronic signal device that comprises a miniature solid state crystal controlled radio signal transmitter at the mailbox. The transmitter sends out a pulse like signal when the mailbox door is opened or closed. In the residence a miniature radio receiver intercepts the pulse signal and converts it to either an audible signal or a visual signal, or both. However, the Conigliaro '333 patent does not have a motion detector activated transmitter which has no moving parts.

Similarly, U.S. Pat. No. 6,222,451 to Leow discloses a delivery signal device for a mailbox that comprises a catcher means (11) connected to the effort arm of a lever (15) which operates a magnetic switch (14). The magnetic switch (14) operates an electrical circuit (19) which then activates a warning system. In one embodiment as taught by the invention, the warning system employs a flashing LED light (30) and this is achieved with the assistance of an integrated electrical circuit (19). The size of the catcher means (11) can be flexibly designed to fit that of a mailbox. To provide equilibrium to the lever (15), a counter weight (13) is provided on the load arm of the lever (15) opposite the catcher means (11). The underside of the load arm of the lever (15) is further provided with a magnet means **(14*a*) operating a normally closed reed switch (14*b*)**. However, the Leow '451 patent does not have a motion detector activated transmitter which has no moving parts.

Lastly, U.S. Pat. No. Des 338,632 to Colberg discloses a combined transmitter and receiver for indicating mail arrival. However, the Colberg '632 patent does not have a motion detector activated transmitter which has no moving parts.

While the above-described devices fulfill their respective, particular objectives and requirements, the aforementioned patents do not describe a mailbox operated signal device that allows mailbox operated motion detector. The Conigliaro '333, Leow '451 and Colberg '632 patents make no provision for a motion detector activated transmitter.

Therefore, a need exists for a new and improved mailbox operated signal device which can be used for mailbox operated motion detector. In this regard, the present invention substantially fulfills this need. In this respect, the mailbox operated signal device according to the present invention substantially departs from the conventional concepts and designs of the prior art, and in doing so provides an apparatus primarily developed for the purpose of mailbox operated motion detector.

SUMMARY OF THE INVENTION

In view of the foregoing disadvantages inherent in the known types of mailbox accessories now present in the prior art, the present invention provides an improved mailbox operated signal device, and overcomes the above-mentioned disadvantages and drawbacks of the prior art. As such, the general purpose of the present invention, which will be described subsequently in greater detail, is to provide a new and improved mailbox operated signal device and method which has all the advantages of the prior art mentioned heretofore and many novel features that result in a mailbox operated signal device which is not anticipated, rendered obvious, suggested, or even implied by the prior art, either alone or in any combination thereof.

To attain this, the present invention essentially comprises a motion detector that is disposable within a conventional mailbox. A wireless transmitter is electrically connected to the motion detector. The wireless transmitter is capable of transmitting a motion detected signal. A wireless receiver is capable of receiving the transmitted motion detected signal. A light is electrically connected to the wireless receiver. The light is for indicating when the motion detected signal is received by the wireless receiver.

There has thus been outlined, rather broadly, the more important features of the invention in order that the detailed description thereof that follows may be better understood and in order that the present contribution to the art may be better appreciated.

The invention may also include a central processing circuit, a speaker, a transmitter housing, a transmitter antenna, a power source connection, a receiver housing, a receiver antenna, a home security system connection and a power supply connection. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved mailbox operated signal device that has all of the advantages of the prior art mailbox accessories and none of the disadvantages.

It is another object of the present invention to provide a new and improved mailbox operated signal device that may be easily and efficiently manufactured and marketed.

An even further object of the present invention is to provide a new and improved mailbox operated signal device that has a low cost of manufacture with regard to both materials and labor, and which accordingly is then susceptible of low prices of sale to the consuming public, thereby making such mailbox operated signal device economically available to the buying public.

Still another object of the present invention is to provide a new mailbox operated signal device that provides in the apparatuses and methods of the prior art some of the advantages thereof, while simultaneously overcoming some of the disadvantages normally associated therewith.

Lastly, it is an object of the present invention is to provide a mailbox operated signal device that is motion detector actuated.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
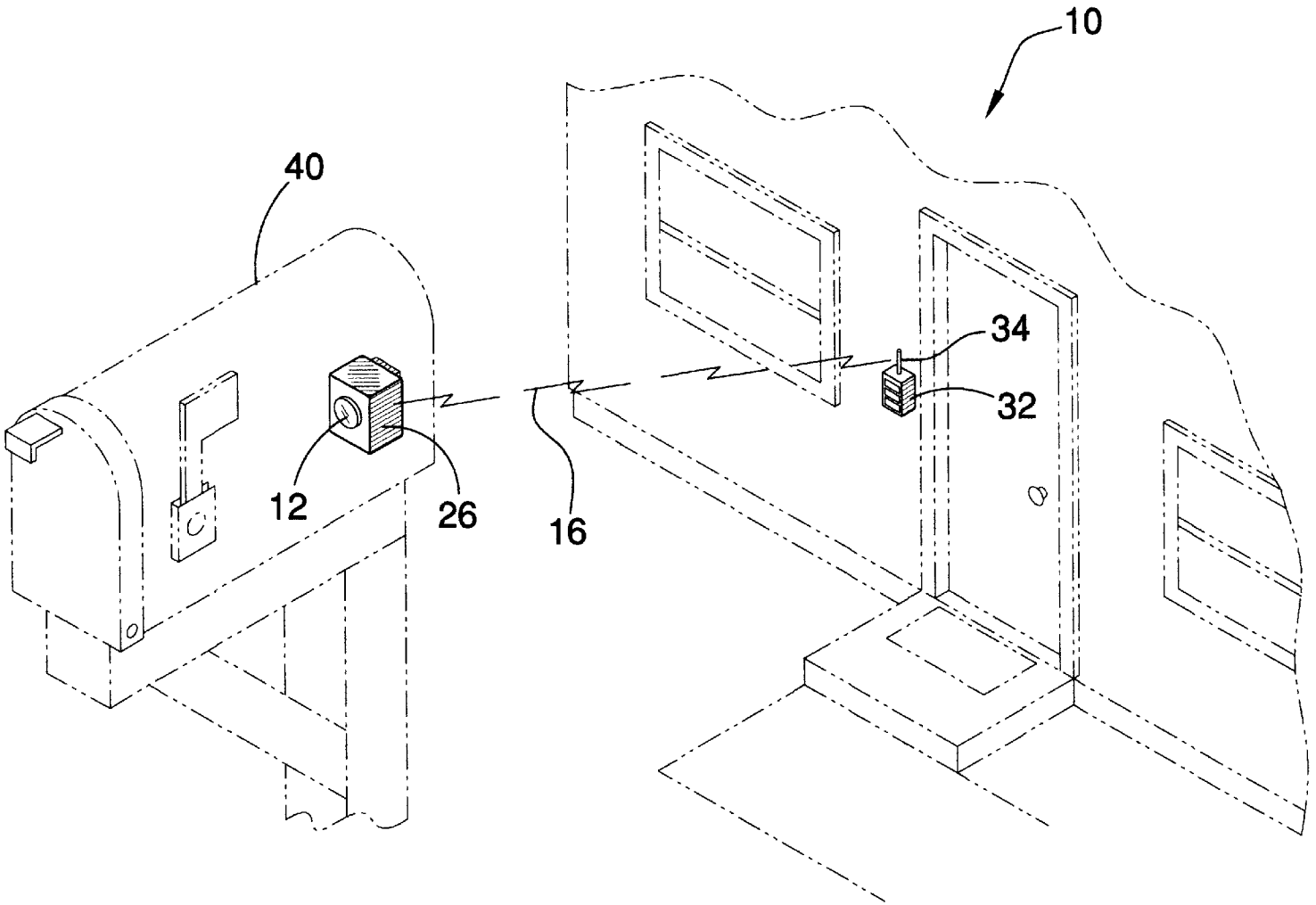
FIG. 1 is a top perspective view of the preferred embodiment of the mailbox operated signal device constructed in accordance with the principles of the present invention.
Figure 2:
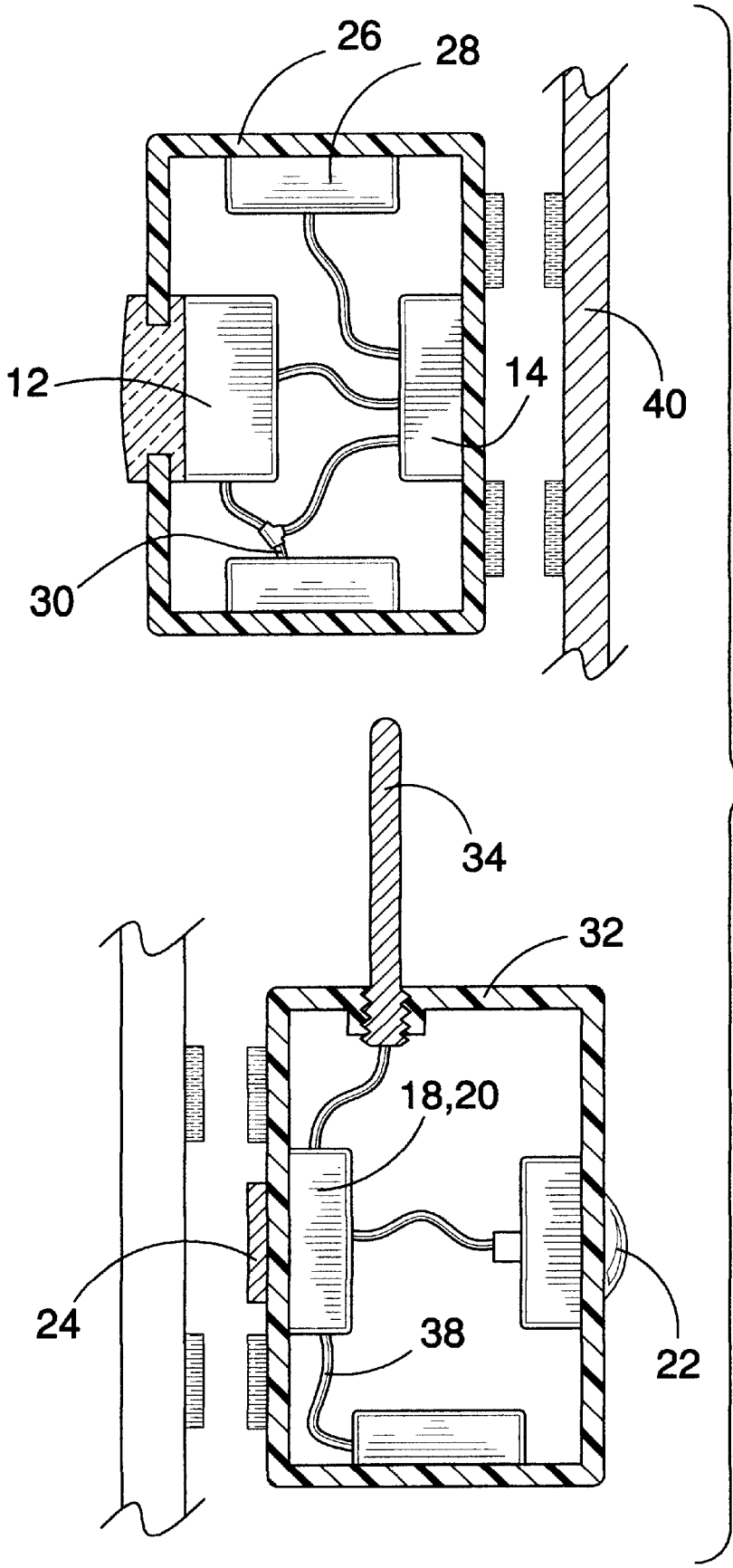
FIG. 2 is a section view of the mailbox operated signal device of the present invention.
Figure 3:
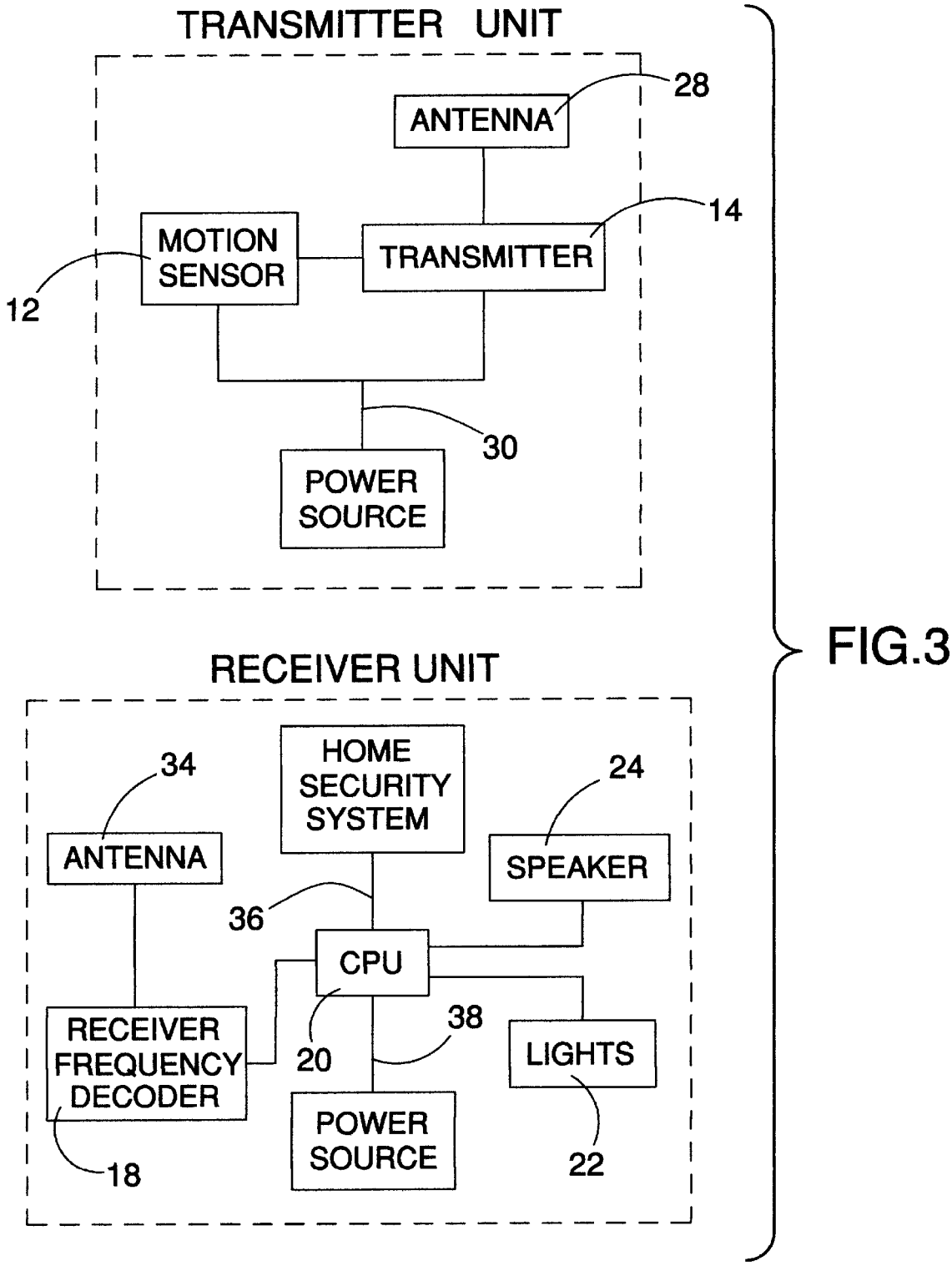
FIG. 3 is a block diagram view of the mailbox operated signal device of the present invention.

Referring now to the drawings, and particularly to FIGS. 1–3, a preferred embodiment of the mailbox operated signal device of the present invention is shown and generally designated by the reference numeral 10.

In FIG. 1, a new and improved mailbox operated signal device 10 of the present invention for mailbox operated motion detector is illustrated and will be described. More particularly, the mailbox operated signal device 10 has a motion detector 12 that is disposable within a conventional mailbox 40. A wireless transmitter 14 (shown in FIG. 2) is electrically connected to the motion detector 12. The wireless transmitter 14 is capable of transmitting a motion detected signal 16. A transmitter housing 26 is detachably connectable to the conventional mailbox 40. The motion detector 12 is connected to the transmitter housing 26. The wireless transmitter 14 is connected to the transmitter housing 26. A wireless receiver 18 (shown in FIG. 2) is capable of receiving the transmitted motion detected signal 16. A receiver housing 32 is connectable to the interior of the residence. The receiver housing 32 is connected to the wireless receiver 18. A receiver antenna 34 is electrically connected to the wireless receiver 18.

In FIG. 2, the mailbox operated signal device 10 is illustrated and will be described. The mailbox operated signal device 10 has the motion detector 12 that is disposable within the conventional mailbox 40. The wireless transmitter 14 is electrically connected to the motion detector 12. The wireless transmitter 14 is capable of transmitting the motion detected signal 16. The wireless receiver 18 is capable of receiving the transmitted motion detected signal 16. A central processing circuit 20 is electrically connected to the wireless receiver 18. A light 22 is electrically connected to the central processing circuit 20. The light 22 is for indicating when the motion detected signal 16 is received by the wireless receiver 18. The transmitter housing 26 is detachably connectable to the conventional mailbox 40. The motion detector 12 is connected to the transmitter housing 26. The wireless transmitter 14 is connected to the transmitter housing 26. A transmitter antenna 28 is electrically connected to the wireless transmitter 14. A power source connection 30 is electrically connected to the wireless transmitter 14. The power source connection 30 is electrically connected to the motion detector 12. The receiver housing 32 is connectable to the interior of the residence. The receiver housing 32 is connected to the wireless receiver 18. The receiver housing 32 is connected to the light 22. The receiver antenna 34 is electrically connected to the wireless receiver 18. A power supply connection 38 is electrically connected to the central processing circuit 20.

In FIG. 3, the mailbox operated signal device 10 is illustrated and will be described. The mailbox operated signal device 10 has the motion detector 12 that is disposable within the conventional mailbox 40. The wireless transmitter 14 is electrically connected to the motion detector 12. The wireless transmitter 14 is capable of transmitting the motion detected signal 16 (shown in FIG. 1). The wireless receiver 18 is capable of receiving the transmitted motion detected signal 16. The central processing circuit 20 is electrically connected to the wireless receiver 18. The light 22 is electrically connected to the central processing circuit 20. The light 22 is for indicating when the motion detected signal 16 is received by the wireless receiver 18. A speaker 24 is electrically connected to the central processing circuit 20. The transmitter antenna 28 is electrically connected to the wireless transmitter 14. The power source connection 30 is electrically connected to the wireless transmitter 14. The power source connection 30 is electrically connected to the motion detector 12. The receiver antenna 34 is electrically connected to the wireless receiver 18. A home security system connection 36 is electrically connected to the central processing circuit 20. The power supply connection 38 is electrically connected to the central processing circuit 20.

While a preferred embodiment of the mailbox operated signal device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal may be used instead of the plastic housing described. And although mailbox operated motion detector have been described, it should be appreciated that the mailbox operated signal device herein described is also suitable for allowing remote motion sensing of any area.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mailbox operated signal device comprising:

a motion detector disposable within a conventional mailbox;

a wireless transmitter electrically connected to said motion detector, said wireless transmitter capable of transmitting a motion detected signal;

a wireless receiver capable of receiving said transmitted motion detected signal;

a central processing circuit electrically connected to said wireless receiver;

a light electrically connected to said central processing circuit, said light for indicating when said motion detected signal is received by said wireless receiver;

a speaker electrically connected to said central processing circuit;

a transmitter housing detachably connectable to a conventional mailbox, said motion detector connected to said transmitter housing, said wireless transmitter connected to said transmitter housing;

a transmitter antenna electrically connected to said wireless transmitter;

a power source connection electrically connected to said wireless transmitter, said power source connection electrically connected to said motion detector;

a receiver housing connectable to the interior of a residence, said receiver housing connected to said wireless receiver, said receiver housing connected to said light;

a receiver antenna electrically connected to said wireless receiver;

a home security system connection electrically connected to said central processing circuit; and a power supply connection electrically connected to said central processing circuit.

* * * * *